US006953377B2

(12) United States Patent
Quercetti

(10) Patent No.: US 6,953,377 B2
(45) Date of Patent: Oct. 11, 2005

(54) SUSPENDED RUNWAY

(76) Inventor: Alessandro Quercetti, Strada San Vito a Revigliasco 48, Torino (IT), I-10133

( * ) Notice: Subject to any disclaimer, the term of this patent is extended or adjusted under 35 U.S.C. 154(b) by 0 days.

(21) Appl. No.: 10/838,188

(22) Filed: May 5, 2004

(65) Prior Publication Data

US 2004/0203316 A1 Oct. 14, 2004

Related U.S. Application Data

(62) Division of application No. 10/051,179, filed on Jan. 22, 2002.

(30) Foreign Application Priority Data

Sep. 18, 2001 (IT) ..... TO2001A0883

(51) Int. Cl.[7] ..... A63H 29/08

(52) U.S. Cl. ..... 446/168; 104/53; 104/104; 472/43

(58) Field of Search ..... 446/168–174; 104/126, 53, 55, 69; 238/10 A, 10 R, 10 E; 472/43, 36, 37

(56) References Cited

U.S. PATENT DOCUMENTS

| | | | | | |
|---|---|---|---|---|---|
| 293,853 | A | * | 2/1884 | Dolbeer | 238/10 R |
| 2,000,808 | A | | 5/1935 | Williams | |
| 3,132,441 | A | * | 5/1964 | Mahovsky | 446/170 |
| 3,587,190 | A | * | 6/1971 | Ashton | 446/168 |
| 3,680,777 | A | * | 8/1972 | Arai | 238/10 E |
| 3,688,436 | A | * | 9/1972 | Wakimura | 104/307 |
| 4,171,090 | A | * | 10/1979 | Eisenburg | 238/10 R |
| 4,898,326 | A | * | 2/1990 | Edwards et al. | 238/10 E |
| 4,953,785 | A | * | 9/1990 | Keska | 238/10 A |
| 5,211,366 | A | | 5/1993 | Cummings | |
| 5,299,735 | A | * | 4/1994 | Thomas | 238/10 B |
| 5,678,489 | A | * | 10/1997 | Wang | 104/56 |
| 5,690,278 | A | * | 11/1997 | Grubb | 238/10 E |
| 5,709,581 | A | | 1/1998 | Rothbarth et al. | |
| 5,908,343 | A | * | 6/1999 | Rothbarth et al. | 446/171 |
| 5,979,783 | A | * | 11/1999 | Toht et al. | 238/10 E |
| 6,155,177 | A | * | 12/2000 | Backfisch | 104/126 |
| 6,170,754 | B1 | | 1/2001 | Halford | |
| 6,315,628 | B1 | | 11/2001 | Quercetti | |

FOREIGN PATENT DOCUMENTS

| | | | | |
|---|---|---|---|---|
| GB | 2139909 A | * | 11/1984 | A63H/18/02 |
| GB | 2155978 A | * | 10/1985 | E01B/23/02 |

* cited by examiner

*Primary Examiner*—Bena Miller
(74) *Attorney, Agent, or Firm*—Young & Thompson

(57) ABSTRACT

A runway over which can travel vehicles driven by gravity, comprising a supporting structure and a track line structure sustained by the supporting structure and extending from a upper start region to a lower arrival region, wherein the supporting structure is limited to a central region of the runway by forming a pillar, and the track line structure includes some track line sections directly connected to the supporting structure and several overhanging track line sections of large extent, which project out of the supporting structure and are sustained by the same by means of rigging systems whose extension can be regulated; these rigging systems establish the geometrical location of the overhanging track line sections. In the embodiments intended to be used as games, the structures are embodied by the composition of systems of composable modular elements, which moreover allow to realize non-suspended runway structures, and which are compatible and integrated with a general system of composable elements, preferably the system of composable elements according to the U.S. Pat. No. 6,315,628.

5 Claims, 6 Drawing Sheets

FIG. 17
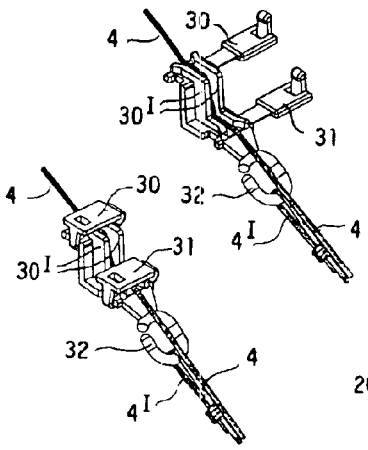
FIG. 18
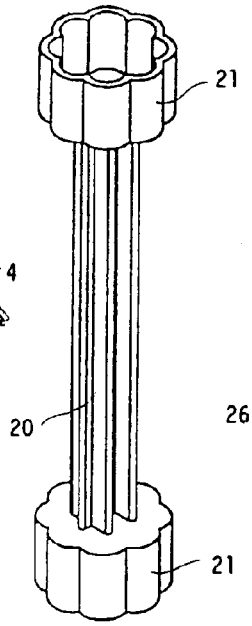
FIG. 13
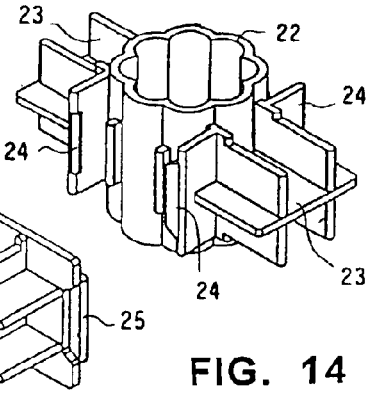
FIG. 14
FIG. 15
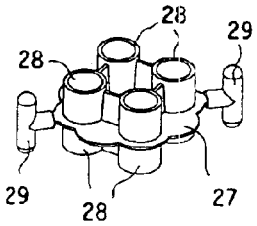
FIG. 16
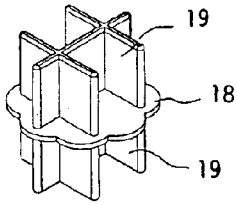
FIG. 12
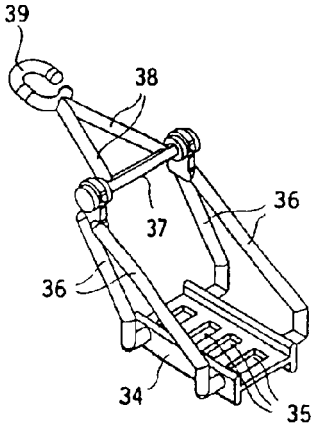
FIG. 19
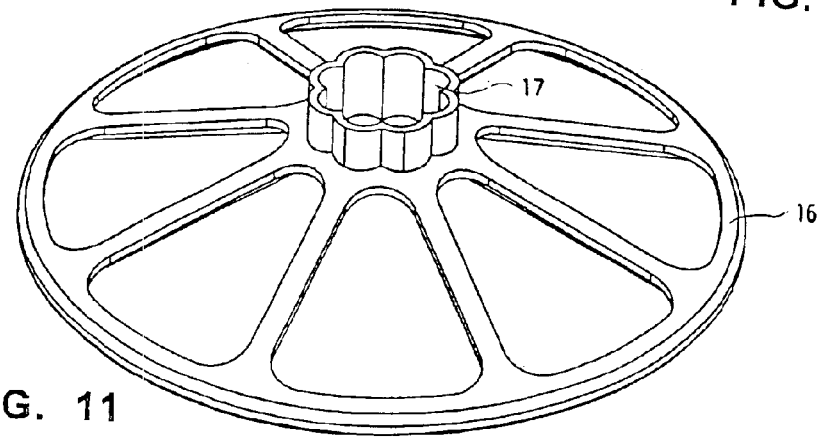
FIG. 11

SUSPENDED RUNWAY

CROSS REFERENCE TO RELATED APPLICATIONS

This application is a division of co-pending application Ser. No. 10/051,179, filed on Jan. 22, 2002, the entire contents of which are hereby incorporated by reference

BACKGROUND OF THE INVENTION

The present invention mainly refers to a suspended runway intended for entertainment purposes.

There are known runway structures intended for entertainment purposes, which comprise a supporting structure and a track line structure forming a runway, sustained by said supporting structure, which runway extends with rectilinear and curvilinear sections departing from a upper start section and ending to a lower arrival section, and is intended to be traveled by non-automotive vehicles, driven by gravity. Such structures are embodied either in a large size (so-called "switch-back railway" or "scenic railway") intended to be traveled by passengers carrying vehicles, or in a small size, intended to be used as a game and to be traveled by vehicle models, which often are represented by simple marbles. In view of its nature, the runway should be descending in its whole, but it may include some sections horizontal or ascending, intended to be traveled by the vehicles by consuming the kinetic energy acquired in a preceding descending section, and in certain cases it may also include some sections whose travel has an acrobatic character, in that a vehicle having a sufficient speed is kept in contact with the runway by the centrifugal force, whereas in stationary conditions or at a reduced speed the vehicle would not be stable on these runway sections.

In the known runways, the supporting structure extends on about the entire area occupied by the whole of the runway, and the track line structure extends about entirely inside the region occupied by the supporting structure, by projecting only for practically negligible extensions with sections overhanging with respect to the supporting structure. This means, on one side, that the supporting structure should have a large expansion, and on the other side that heavy limitations are imposed to the design of the track line structure and, therefore, to the whole of the runway.

Moreover, the fact that the travel of the vehicles takes place substantially inside the supporting structure limits the emotions excited by the vehicle travel, both in the carried passengers, when they exist, and in those who observe from outside the vehicle travel.

SUMMARY OF THE INVENTION

A first object of this invention is to propose a runway intended to be traveled by substantially non-automotive vehicles driven by gravity, in which the extension of the track line structure should be widely independent from the extension of the supporting structure, whereby the two structures may be designed in a within certain limits mutually independent way, also enjoying a very greater freedom of design.

Another object of the invention is to propose such a runway in which the track line structure can project on large extensions outside the area occupied by the supporting structure, whereby special emotions may be excited both in the possible passengers carried by the vehicles traveling the runway, and in those who observe from outside the vehicle travel.

Still an object of the invention is to propose a runway which, in its embodiment intended to be used as a game, may be built by giving to it conformations and trajectories widely variable and alterable at will. This fact particularly affords to the game a formative character, in view of the need that the player appreciates, from reasoning and experience, the different factors which should be satisfied in order that the runway may be entirely traveled by gravity, and in order that the vehicles do not lose their stability in any section of the runway.

Finally, an object of the invention is to allow an effective integration of a system for the construction of runways intended to be used as games, with a general system for the composition of static and dynamic constructions using composable modular elements.

The essential feature of the runway according to the invention is that the supporting structure is limited to a central region of the whole of the runway, and that the track line structure includes some sections directly connected to the supporting structure and some overhanging sections of large extent which project out of the supporting structure, said overhanging sections of the track line structure being connected to the supporting structure by means of rigging systems, which support said overhanging sections and establish their geometrical location.

In this way, the whole of the runway comprises a track line structure which may be designed with a great freedom, both in its trajectory and in its extension, with respect to the limited extension of the supporting structure, and the travel of the vehicles on the track line structure takes place for a noticeable part thereof outside the central supporting structure. In the case of a runway traveled by passengers carrying vehicles, the passengers experience, during the travel on the overhanging sections of the track line structure, a sensation of flight, whereas in the case of a runway used as a game the travel of the vehicles may be better observed from outside, because the look is not disturbed as usually by the presence of an extensive supporting structure.

According to an important feature of the invention, said rigging systems which support the overhanging sections of the track line structure are formed by cables whose extension can be regulated. This feature is of great importance because, in this way, the conditions of the vehicle travel on the runway may be regulated not only on the basis of a previous design study, but also on the basis of the experimental ascertainment of the vehicle behavior. This possibility may be enjoyed, in addition to the initial setup of the position and slope of the sections of the track line structure, even at a later time, in order to attain different behaviors of the vehicles and therefore to increase the attractivity of the runway.

It is of advantage that said central supporting structure substantially forms a pillar, possibly reduced to a substantially vertical mast having substantially horizontal extensions which support the track sections and to which are connected, possibly by means of uprights, the rigging systems. In this way, the extension of the supporting structure can be reduced at a minimum with respect to the whole extension of the runway.

In the embodiments intended to be used as games, both said supporting structure and said track line structure are embodied by the composition of systems of composable modular elements. This allows obtaining, by means of a given element system, a plurality of different runways, with the possibility of starting the activity on relatively simple structures and then continue by embodying more extensive and complex structures, as the person who composes the construction becomes more capable and experienced.

Particularly, it is of advantage that said system of composable modular elements also allows composing more simple runway structures, wherein all the track sections are directly supported by the supporting structure and are not suspended by means of rigging systems. This fact allows those who start constructing runways still having little ability and experience, to limit the construction at first to non-suspended runways of a substantially conventional kind, whose design and composition are less difficult, and to venture only at a later time on the composition of suspended runways, which of course oppose very greater difficulties. The graduation of the difficulty is of great importance for the formative character of the game. Moreover it renders the game suitable for subjects of lower age.

It is very advantageous that said system of composable modular elements specifically intended for the composition of the supporting structure and the track line structure of the runway be compatible and integrated with a general system of composable elements for the composition of static and dynamic structures. This feature allows those who set about constructing a runway to make use of a kind of composable elements to which they are already accustomed, and particularly to take advantage of the experience already developed in building constructions of a different kind, and also allows, if useful, to integrate the runway structure into the structure of a more complex construction.

It is of advantage that said general system of composable elements for the composition of static and dynamic structures, with which said system of composable modular elements specifically intended for the composition of the supporting structure and the track line structure of the runway is compatible and integrated, is the system of composable elements according to the U.S. Pat. No. 6,315,628. The versatility of this element system is very advantageously fit for the integration with elements specifically intended for the composition of a runway.

BRIEF DESCRIPTION OF THE DRAWINGS

These and other features, objects and advantages of the present invention will more clearly appear from the following description of some embodiments, to be regarded as non limiting examples guiven with reference to the appended drawings, wherein:

FIG. 11 shows in perspective a base element for the supporting structure of the runway.

FIG. 12 shows in perspective a coupling element for the supporting structure of the runway.

FIG. 13 shows in perspective an element having the length of more than one module, for the supporting structure of the runway.

FIG. 14 shows in perspective a multiple connection element, so-called knot, for the supporting structure of the runway.

FIG. 15 shows in perspective an additional element for the connection element of FIG. 14.

FIG. 16 shows in perspective a coupling element of the supporting structure of the runway, having hooking means for the rigging system.

FIGS. 17 and 18 show in perspective, respectively in open and closed condition, an element for regulating the length of a cable of the rigging system.

FIG. 19 shows in perspective a suspension element for the track sections forming the runway.

DETAILED DESCRIPTION OF THE PREFERRED EMBODIMENTS

The drawings mainly refer to the embodiments of the suspended runway intended to be used as a game, whereas only a single Figure refers to the embodiment of the suspended runway intended to be traveled by passengers carrying vehicles. This is justified in that, in fact, an embodiment to be used as a game poses the heavier problems, because it should be built by a person who is in no way skilled in the building technics. On the contrary, a runway structure of large size, intended to be traveled by passengers carrying vehicles, is always designed and built by skilled persons, for whom the teachings given by the present specification and drawings are widely sufficient, when integrated with the usual knowledge of those skilled in the building technics, for proceeding to the application of this invention in that specific field.

Figure 1:
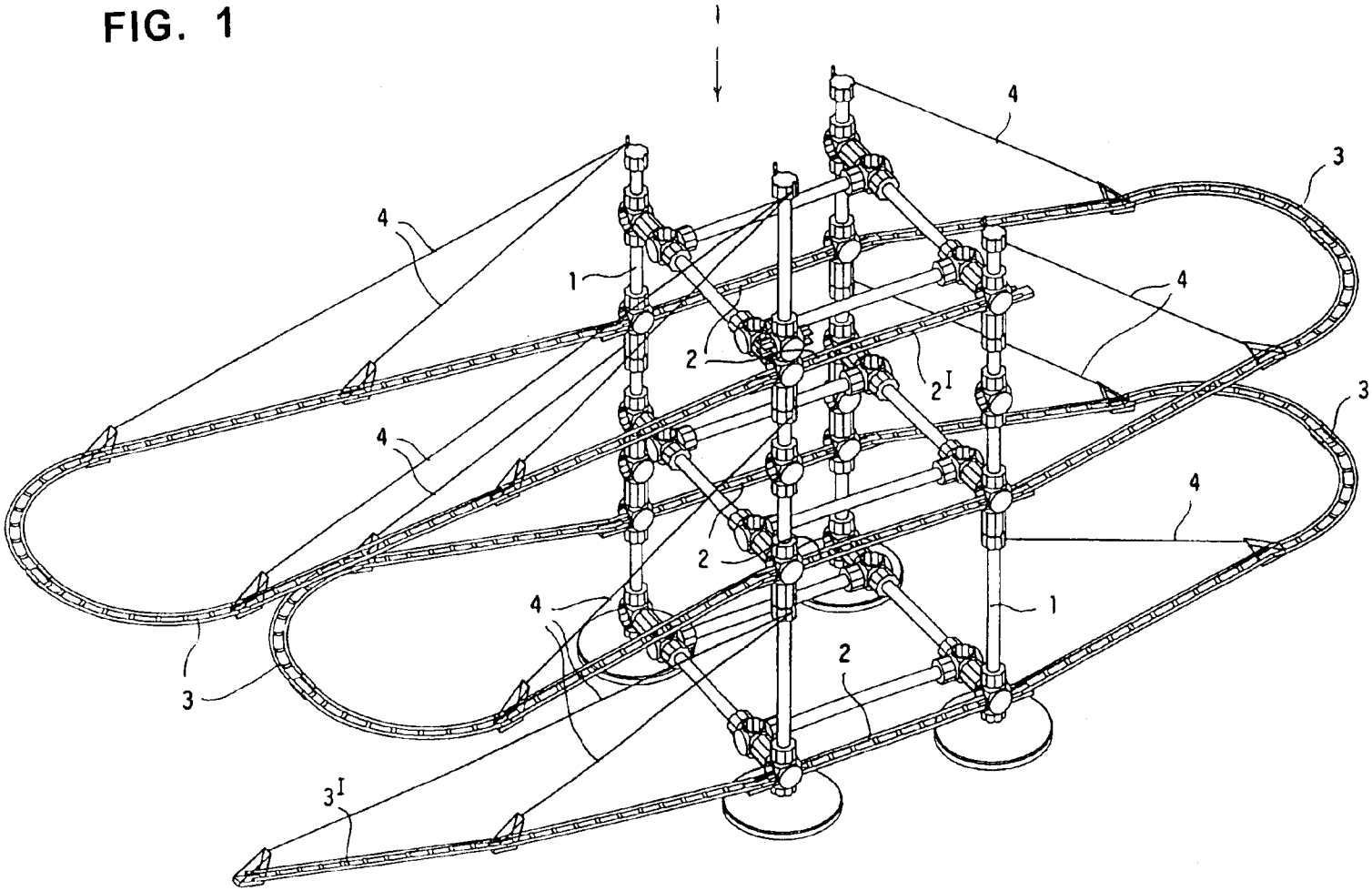
FIG. 1 diagrammatically shows in perspective a first example of a suspended runway according to this invention, intended for being used as a game.

The suspended runway according to this invention is shown in its whole in FIG. 1, showing a first example of its several possible embodiments, and in this case an embodiment intended to be used as a game. According to the invention, the supporting structure, which is designated in its whole by reference 1, is limited to a central region of the runway, and in this case it comprises a single pillar. In other embodiments could be foreseen two or more pillars, however always limited in their whole to a central region of the runway, whereby they could also be considered as separate portions of a single pillar.

The track line structure forming the proper runway includes some track sections 2 which are directly sustained by the supporting structure 1, but it is a characteristic feature of the invention that the track line structure also includes several track sections 3 which project, overhanging for a large extension, out of the supporting structure 1. These track sections 3, which cannot be sustained directly by the supporting structure 1 because they are located outside the same, are sustained by the supporting structure by means of cables 4, which form rigging systems connected, at a first end, to the supporting structure and, at the opposite end, to the overhanging track sections 3.

Observing FIG. 1, one understands how a suspended runway according to the invention differs from a conventional runway, and how greater freedom of design it allows. Moreover it may be realized by intuition that the travel of a vehicle or vehicle model on such a suspended runway will be more attractive than the travel on a conventional runway, and that, in the embodiments in large size for passenger carrying vehicles, in the regions determined by the overhanging track sections 3 the passengers will receive a sensation of flight, completely absent in a conventional runway.

Now describing in more detail the runway of FIG. 1, it may be observed that the supporting structure 1 forming a pillar is, in this case, a reticular structure including columns and cross bars, which structure, though occupying in plan a reduced space, may have a great resistance and stability. It directly supports the track sections 2, which in this case are connected at both ends to the supporting structure 1, whereas a great part of the runway is formed by groups of track sections 3 which project in an important way, overhanging at both opposite sides of the supporting structure 1. The groups of overhanging track sections 3 comprise in general rectilinear track sections directed outwards and towards the supporting structure 1, and curvilinear track sections which connect together said rectilinear track sections. The runway initiates from a upper start track section 2' and ends for example with a lower arrival track section 3', which in this case is ascending in order to slow down and stop the vehicles. The passage of the vehicles between non-suspended track sections 2 and suspended track sections 3 may advantageously take place through hollow elements of the supporting structure 1. As it may be observed, the runway follows a substantially helicoidal path with oval plane. This kind of trajectory is preferable for technical and practical reasons, however it is not exclusive because, by resolving some problems posed by non-oval paths, the user can also chose different trajectories.

All the overhanging track sections 3, which cannot be directly sustained by the supporting structure 1, are supported therefrom by means of cables 4, which may preferably be regulated, and form a rigging system, being fixed at one end to the track sections 3 to be sustained and at the opposite end to the supporting structure 1.

As it may be understood, the regulation of the length of cables 4 allows regulating both the position and the slope of the track sections 3 and, as a consequence, the travel conditions of the vehicles driven by gravity, in order to attain both their stability on the runway and the desired travel mode.

As already said the runway, when embodied for the use as a game, is advantageously composed by a system of composable elements which will be described later on. It is to be remarked that this allows those who build the suspended runway to give to it extremely variable and modifiable shapes and trajectories, and this ensures the development of a very useful practical experience, in addition to the need of reasoning on the design. It is thus possible to commence the construction with relatively simple structures, and to confront more complex structures after development of a sufficient experience. This ensures a very formative effect of the game.

Figure 2:
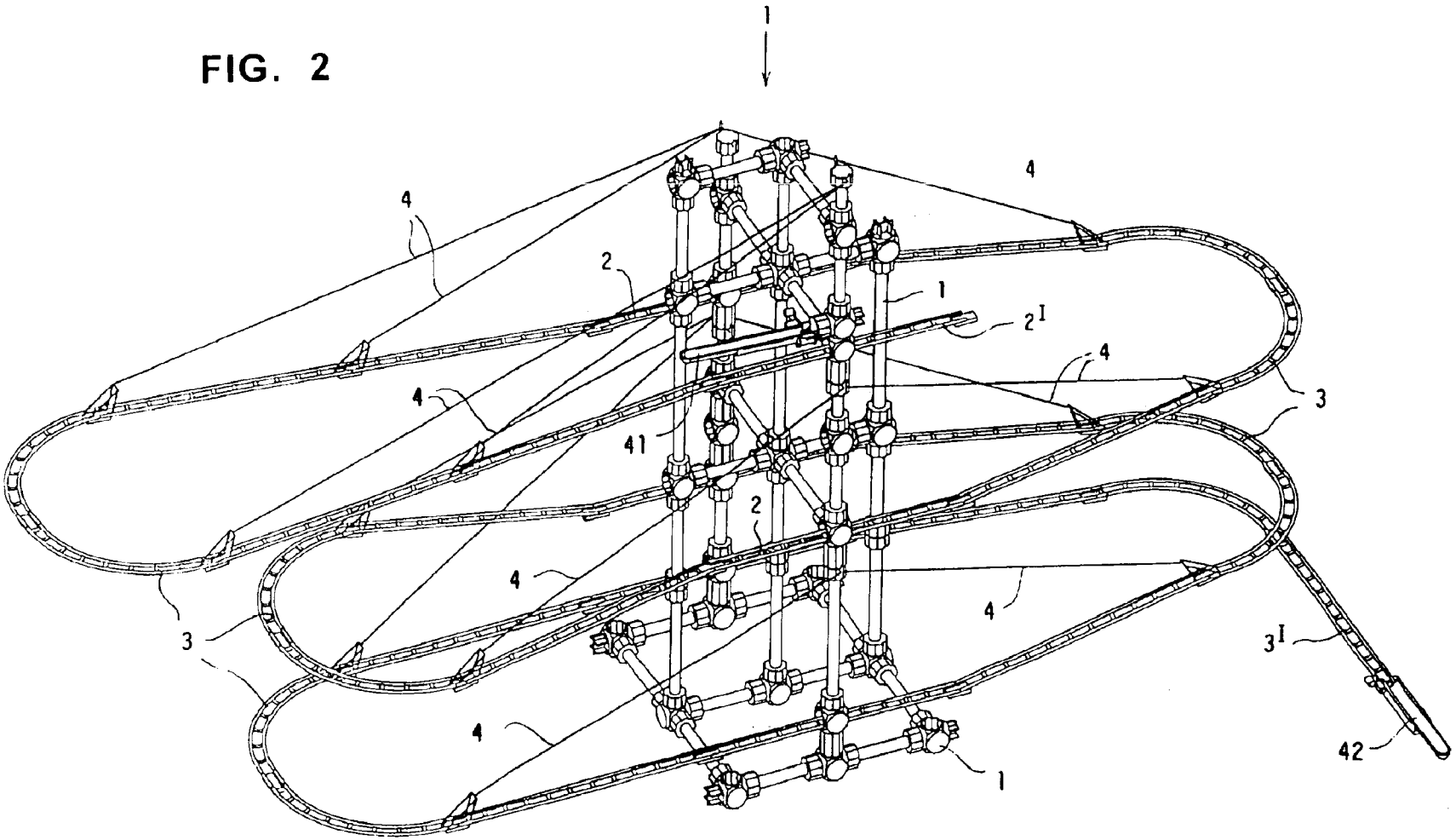
FIG. 2 diagrammatically shows in perspective a second example of a suspended runway according to this invention, also intended for being used as a game.

FIG. 2 shows a second example of suspended runway to be used as a game, which can be realized by means of the system of composable elements according to the invention. The difference of this runway with respect to that according to FIG. 1 mainly resides in that the track sections 2 directly connected to the supporting structure 1 are hooked thereto near their own central region, rather than to be connected to the supporting structure at both their own end portions. In this way, the track line structure becomes external in an about complete manner with respect to the supporting structure. Moreover, in the embodiment of this example the runway ends with an extended horizontal track section 3' intended to be traveled by inertia. There are also foreseen two terminal stations, a upper start station 41 for passing the vehicles to the initial track section 2', and a lower arrival station 42 for receiving the vehicles which come from the end track section 3'.

Figure 3:
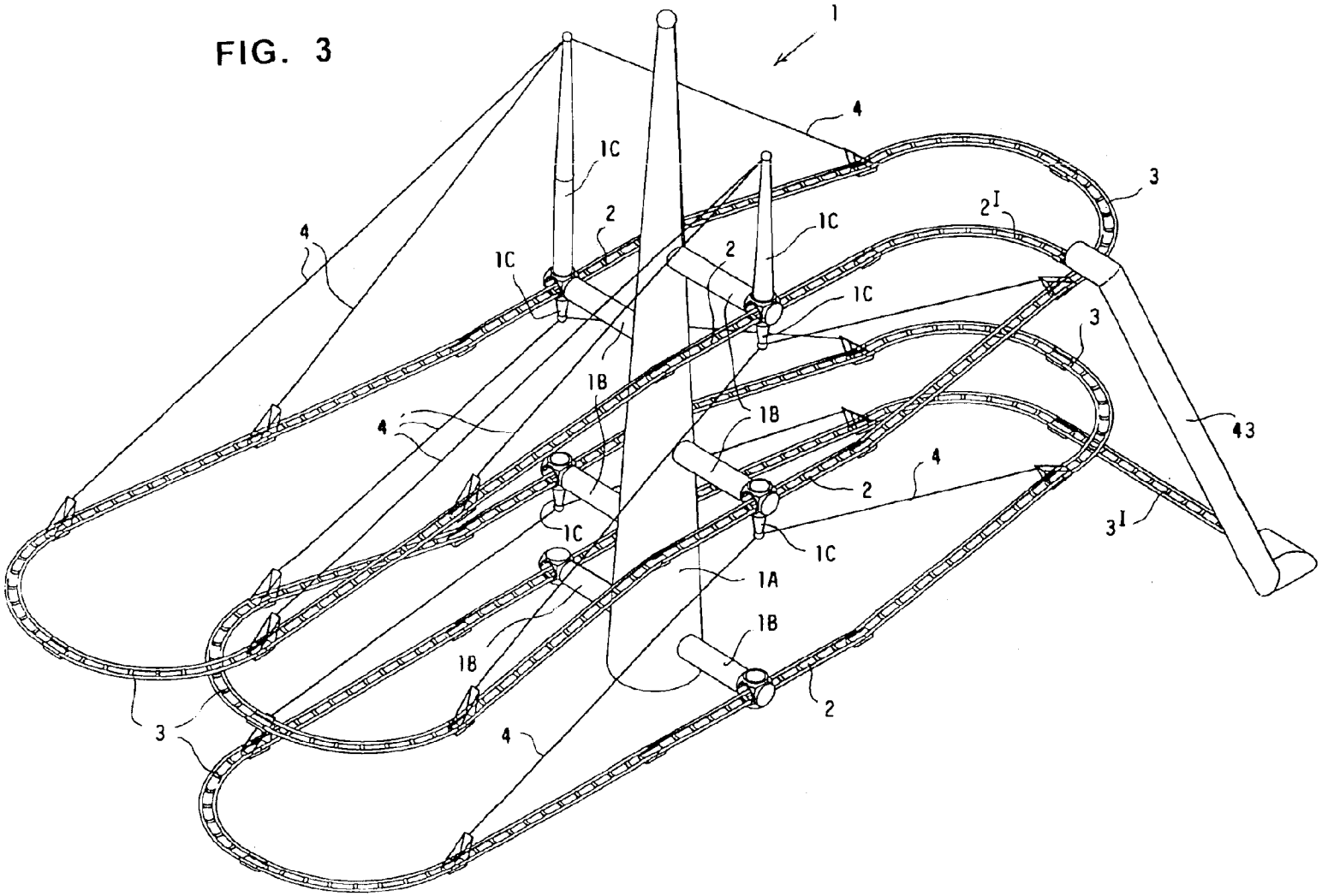
FIG. 3 diagrammatically shows in perspective an example of a suspended runway according to this invention, intended for being traveled by passengers carrying vehicles.

FIG. 3 represents in a very diagrammatic manner an example of a suspended runway according to the invention, which in this case has the character of a runway intended to be traveled by passengers carrying vehicles. Contrary to the former cases, the supporting structure 1 of this example is not made by composable elements. It includes a central vertical mast 1A from which depart horizontal extensions 1B; to these extensions are directly connected the track sections 2, and from them extend upwards or downwards some uprights 1C to which are connected the rigging systems sustaining the overhanging track sections 3. In this case there is foreseen a lifting device 43 for lifting the vehicles from the lower arrival track section 3' to the upper start track section 2'. The remaining of the structure may substantially correspond to that has been formerly described, except, of course, its embodiment in a larger size and with shapes suitable for the travel of passengers carrying vehicles.

Figure 4:
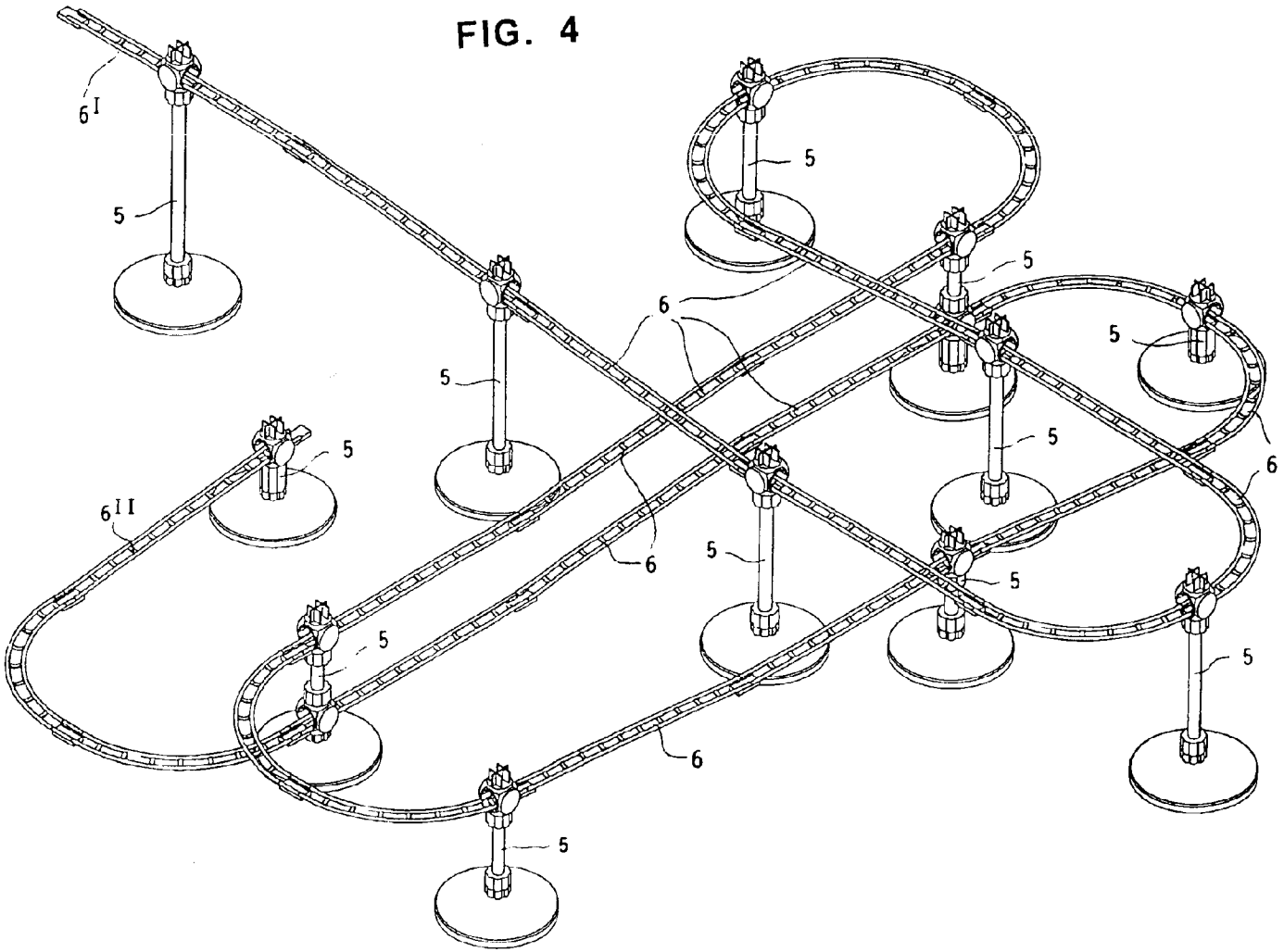
FIG. 4 diagrammatically shows in perspective an example of a non-suspended runway which can be realized by means of the composable elements according to this invention.

It has been already said that, by using the composable elements intended for the realization of a suspended runway for use as a game, it is also possible to realize a more simple non-suspended runway, as for example that represented in FIG. 4. In this case the structure is of a substantially conventional kind, and it comprises a number of props 5, forming in their whole a complex and extended supporting structure, directly sustaining rectilinear and curvilinear track sections 6, departing from a upper start track section 6' and ending to a lower final track section 6".

It is evident that such a runway may also be of interest, however it is wanting in the specific attraction of a suspended runway. On the other hand, it is extremely easier in design and realization, and therefore it may be a useful propaedeutical step for the development of a certain experience in the initially unprepared builder, who, after having developed his experience in building such non-suspended runways, will be prepared to the building of suspended runways. Therefore, the described possibility extends the field of practical application of the system of composable elements according to the invention, and noticeably enhances its formative character, by allowing relatively easy initial realizations and inciting then to more engaging constructions. Moreover, in this way the game will result suitable also for subjects of more reduced age.

As already said, it is assumed preferable that the system of composable elements specifically intended for the realization of suspended runway structures, and incidentally also for the realization of non-suspended runways, be compatible and integrated with the general system for the composition of static and dynamic structures described in the U.S. Pat. No. 6,315,628. That system is mainly characterized by female tubular coupling members whose walls are defined in cross section by eight circle arcs symmetrically subsequent with respect to the center of the coupling member. Therefore, this particular structure of the female coupling members is maintained in the elements described here, specifically intended for the realization of supporting structures for runways, and all the elements are provided with features and shapes compatible with this structure of said female coupling members. The main elements specifically intended for the realization of runway structures are described in the following.

Figures 5, 6, 7, 8, 9, 10:
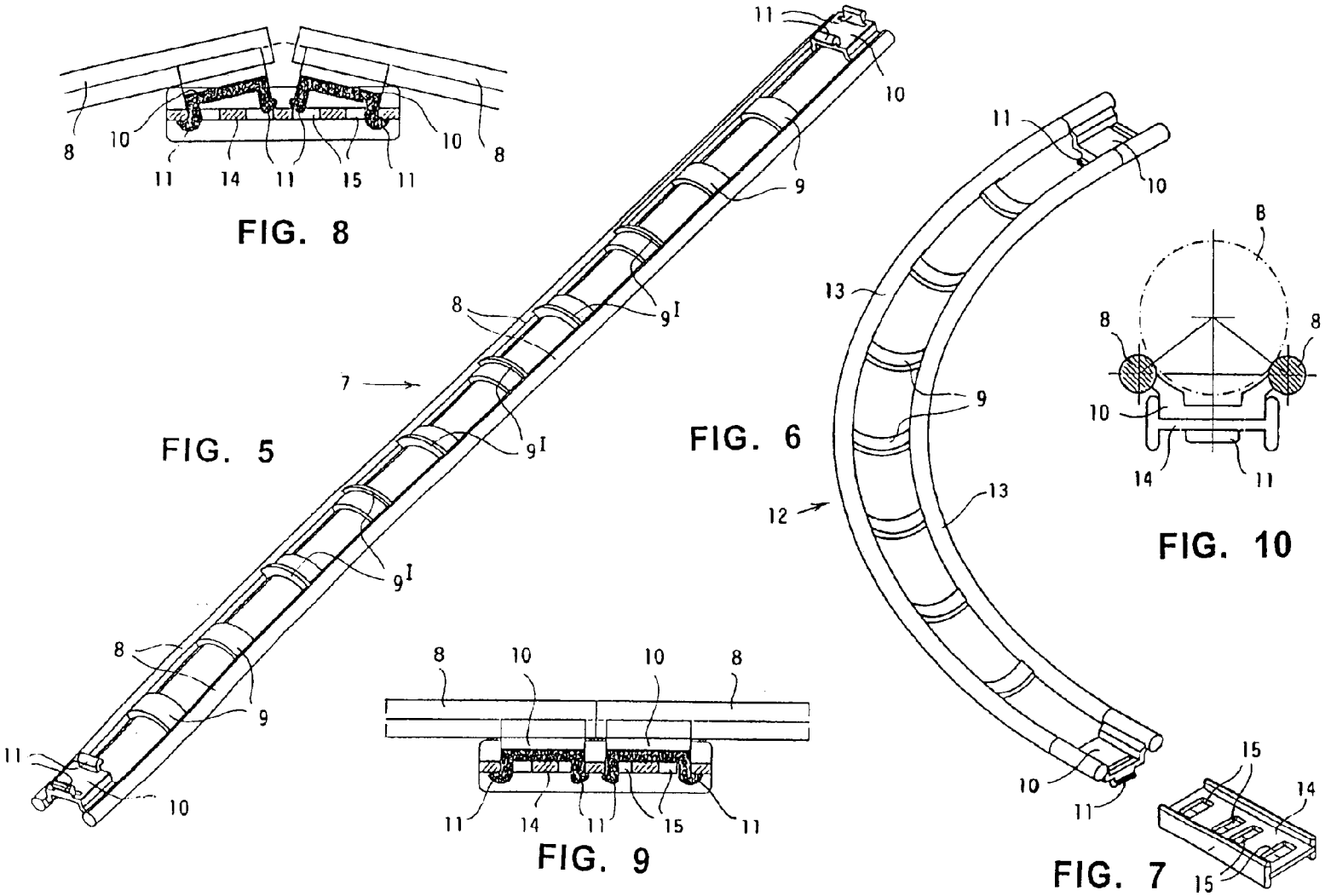
FIG. 5 shows in perspective a rectilinear track section intended for composing the track line of the runway, seen from bottom.
FIG. 6 shows in perspective a curvilinear track section intended for composing the track line of the runway, seen from top.
FIG. 7 shows in perspective an element for coupling between track section intended for composing the track line of the runway.
FIG. 8 and FIG. 9 show in longitudinal section and at a larger scale the manner of coupling between two track sections according to FIGS. 5 and 6, by means of the coupling element according to FIG. 7.
FIG. 10 diagrammatically shows at a larger scale and in cross section the relative positions of a track section, a coupling element, and a marble intended to travel on the track sections.

FIG. 5 shows a rectilinear track line section 7, seen from bottom. It has the character of a track section, comprising a pair of rectilinear bars 8 mutually connected at intervals by curved ties 9, whose concavity faces the side of the track intended to be traveled. At each end of the track section there is provided a coupling tie 10 having at bottom two teeth 11 described later on. Moreover there are provided at bottom some projections 9', whose purpose is that of stabilizing the longitudinal position of the track section when it is sustained by the supporting structure only in the central region, as in the embodiment of FIG. 2, or anyway in a single region, and not at both ends thereof as in FIG. 1. Preferably, as shown by FIG. 5, there are provided several pairs of said lower projections 9'. The reason of this multiplicity is that, in the realization of the runway, the builder may decide to impart to certain track sections a slope considerably different from the slope of other track sections. In this case the correct position of the various track sections may be impaired, and then it should be restored. This is obtained by suitably modifying the position where some track sections are fixed to the supporting structure. The multiplicity of the lower centering projections 9' ensures the possibility of easily effecting such modifications, which may be required to be different from case to case.

FIG. 6 represents in a similar way a curvilinear track line section 12, which differs from the rectilinear track line section 7 only in that the bars 13 forming the track section are concentrically curved instead of being rectilinear. In this example, the curve extends for 90°, however also different angular extensions of the curved sections may be chosen. The ties 9 and the end coupling ties 10 are identical to those already described of the rectilinear track line section 7.

FIG. 7 represents a coupling element 14 serving for the mutual connection, in any combination, of track sections 7 and 12. It has a wide-H cross section wherein can accommodate a coupling tie 10, and it has two pairs of transverse slots 15 suitable for engaging with the teeth 11 of the coupling ties 10. The connection between two rectilinear track sections 7 (or, in the same manner, between two curvilinear track sections 12 or else between mixed track sections 7 and 12) by means of the coupling element 14 is effected as shown by FIGS. 8 and 9. One of the teeth 11 of each track section is engaged in a slot 15 of the coupling element 14, both said parts being aligned in plan but forming an angle in elevation (FIG. 8). Thereafter the other tooth 11 of each track section is engaged by elastic snap into the corresponding slot 15, thus arranging both track sections in complete mutual alignment (FIG. 9). In this way one can compose a track line of every desired length and path, by using a suitable number of rectilinear track sections 7 and curvilinear track sections 12.

It will be observed by FIG. 8 that the two teeth 11 of each coupling tie 12 have different outlines. This is due to the opportunity that the engagement of one of the teeth be rendered irreversible, whereas to the other tooth is given the function of a disengageable hooking.

The track sections 7 and 12 are formed of a semi-rigid plastic material which allows a limited curvature of the track section around a transversal axis parallel to the travel plane of the track as well as a limited torsion of the same along a longitudinal axis, but no noticeable deformation of the track section in the transverse direction. This allows to arrange the track line along the desired trajectory, however without compromising the possibility of correct travel of the vehicles on the track line.

FIG. 11 shows a base element for the supporting structure of the runway. This element includes a rest portion 16, which in this example has the shape of a spoked wheel, and a central sleeve 17 whose cross section comprises eight circle arcs symmetrically subsequent with respect to the center of the element, surrounding a cavity, like the already described cross section of a tubular female coupling member of the element system for the composition of static and dynamic constructions as described in the U.S. Pat. No. 6,315,628. Said cross section is maintained in all the female coupling members, in the present system of composable elements too.

It is of advantage that the just mentioned section of a female member and the cross section of the track elements 7 and 12 are mutually proportioned in such a way, that the track section can be fixed by elastic snap into the cavity of a female member by engaging both bars 8 or 13 of a track section into two not directly subsequent arcs of the section of a female member. This allows a particularly easy mounting of the track sections 2 which are to be directly sustained by the supporting structure 1.

FIG. 12 shows a coupling element for the supporting structure, which is intended to allow the mutual connection between two female coupling members. It comprises a thin plate 18 having the same outline of a female coupling member and, projecting from both faces of this plate, plane surfaces 19 having six edges suitable for being frictionally inserted, according to two orthogonal directions, into six of the eight arcs of a female coupling member.

FIG. 13 shows an element whose length is multiple of a module, formed by a trunk 20 having at both ends female coupling members 21. These elements may advantageously be provided in different lengths, all multiple of a module, in order to realize, using a reduced number of elements, the columns and the cross bars of the supporting structure, in the desired measures.

FIG. 14 shows a multiple connection element, so-called knot, which is formed by a tubular portion 22 having the profile of a female coupling member, from whose opposite sides project male coupling surfaces 23 corresponding to the already described surfaces 19. Moreover, the knot is also provided with engagement means 24 for one or two additional elements, one of which is represented in FIG. 15. It comprises a plate 25 suitable for engaging said engagement means 24, and male coupling surfaces 26 corresponding to the male coupling surfaces 23. This additional element allows increasing the number of directions according to which the knot may exert its activity.

The tubular portion 22 of the knot has a through cavity, and therefore it is particularly suitable for being traversed by a track section 7 or 12 and for supporting the same.

FIG. 16 shows a connection element for the supporting structure, intended to allow the mutual connection between two female coupling members and moreover to allow hooking a cable which supports overhanging elements. It comprises a thin plate 27 having an outline like that of a female coupling member, and projecting from both sides of said plate four cylindrical sleeves 28 suitable for being frictionally inserted into four of the eight arcs of a female coupling member. Moreover, from the peripheral edges of said plate 27 project hooks 29 suitable for receiving a noose formed by a suspension cable 4. These elements serve for providing on the supporting structure some fixing points for the rigging system which sustains the overhanging track sections.

FIGS. 17 and 18 illustrate an element which forms a device intended to regulate the extension of a suspension cable. It is shown in FIG. 17 open for the insertion of a cable, and in FIG. 18 closed in operative position. This element comprises a pair of clamps 30 and 31, mutually connected in steps and suitable for being snap closed, as well as a hook 32 also serving as a control handle. A cable 4 (FIG. 17) is inserted in the first clamp 30, is brought in correspondence of the second clamp 31 and is inserted therein. From here the cable extends up to a suspension member (for example, to a hook 39 of an element according to FIG. 19, described later on) and it returns therefrom by forming a ring 4', which is engaged in the hook 32. Therefore, to the cable 4 are imposed subsequent deviations, each time in a sense opposite to the preceding one. When both clamps are closed (FIG. 18), the cable is kept in position by the clamps and assumes a self-locking configuration. It receives therefore a retaining action and cannot glide neither spontaneously nor under the action of a pull. However, the element 30–32 can be grasped and easily made to glide along the cable. In this manner one may modify the extension of the cable portion extending up to the suspension element and returning therefrom, thus regulating the useful length of the cable. The hook 32, used as a handle, renders easy this maneuver, without incurring in resistance and allowing the person to turn the attention to the effects produced by the regulation in course of execution on the position and slope assumed by the track elements sustained by the cable, in order that they can be disposed in the desired position. Some walls 30' are advantageously provided, forming guide surfaces facilitating the correct engagement of the cable into the clamps.

FIG. 19 shows a coupling element between two track sections, which in addition allows fixing a suspension cable without hindering the travel on the track section. This element includes a coupling element 34, which is in part identical to the already described coupling element 14, and like that is provided with two pairs of transverse slots 35 for hooking the track sections, but it differs from the former in that from its sides project two uprights 36, which in this case are triangular, at the ends whereof a pivot 37 connects a movable element 38 by allowing its rotation. The movable element 38 ends with a hook 39 to which can be fixed an end noose of a suspension cable 4. The space left free by the uprights 36 and the pivot 37 over the coupling element 34 is designed sufficient for allowing the travel of a vehicle on the track section sustained by the coupling element 34. The orientability of the movable element 38 ensures that it spontaneously arranges itself along the pull direction of the cable connected to it.

The element according to FIG. 19 allows therefore to mutually connect two track sections 7 or 12 and to join at the connection point one end of a suspension cable 4, whose opposite end is connected to the supporting structure 1, for example by means of an element 27–29 according to FIG. 16.

The composable modular elements described allow therefore to realize suspended runways as for example those shown in FIGS. 1 and 2, as well as, by omitting the elements purporting to the rigging systems, a non-suspended runway such as for example that shown in FIG. 4. Since the described elements are designed in such a way as to be compatible and integrated with the system of composable elements according to the U.S. Pat. No. 6,315,628 also the elements of that system may be used along with the described elements, thus extending, practically without limits, the possibility of realizations offered by a thus integrated element system.

It should be realized that this invention is not limited to the embodiments described and shown by way of examples. Several modifications are possible for those skilled in the art, especially in the design of the composable modular elements and in the realization of additional elements, suitable for integrating the system. For example, it is possible to provide special stations for housing or receiving the vehicles both in the start station and in the arrival station, and lifting means can be provided for returning the vehicles from the arrival station to the start station. The vehicles intended to travel on the runway will be mainly driven by gravity, but this does not exclude the possible provision of some auxiliary driving means.

What is claimed is :

1. A system of composable modular elements for the composition of a track line structure of a runway intended to be used as a game, comprising a number of track sections, each track section including a pair of bars, curved ties connecting at intervals of said bars, said ties being upwardly concave in transverse cross section, said pair of bars having at each end a coupling tie, each coupling tie having on its underside two conecting teeth.

2. An elements system as set forth in claim 1, wherein each said track section has on its underside some projections intended to stabilize its longitudinal position.

3. An elements system as set forth in claim 1, wherein each said track section is formed of a semi-rigid plastic material capable of allowing a limited curvature of the track section around a transverse axis parallel to the plane of said track section and a limited torsion of said track section, but no substantial deformation thereof in the transverse direction.

4. An elements system as set forth in claim 1, comprising a number of coupling elements intended for mutually connecting said track sections, each said coupling element having a wide-H cross section wherein can accommodate one of said coupling ties, and having two pairs of transverse slots suitable for engaging with said connecting teeth of the coupling ties.

5. An elements system as set forth in claim 1, comprising a number of coupling elements intended for mutually connecting and for supporting said track sections, each said coupling element having a wide-H cross section wherein can accommodate one of said coupling ties, having two pairs of transverse slots suitable for engaging with said connecting teeth of the coupling ties, and having two uprights extending from opposite sides of the element, a pivot connected to said uprights and a movable member mounted on said pivot and having a hook suitable for receiving the connection of a cable.

* * * * *